US008915733B2

(12) United States Patent
Cao et al.

(10) Patent No.: US 8,915,733 B2
(45) Date of Patent: Dec. 23, 2014

(54) SELECTIVE ADJUSTMENT OF HEAT FLUX FOR INCREASED UNIFORMITY OF HEATING A CHARGE MATERIAL IN A TILT ROTARY FURNACE

(75) Inventors: Jin Cao, Allentown, PA (US); Xiaoyi He, Orefield, PA (US); Aleksandar Georgi Slavejkov, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 926 days.

(21) Appl. No.: 12/944,021

(22) Filed: Nov. 11, 2010

(65) Prior Publication Data

US 2012/0122047 A1 May 17, 2012

(51) Int. Cl.

| | |
|---|---|
| ***F27D 7/00*** | (2006.01) |
| ***F27B 7/12*** | (2006.01) |
| ***F27B 7/34*** | (2006.01) |

(52) U.S. Cl.

CPC .... *F27B 7/12* (2013.01); *F27B 7/34* (2013.01)
USPC ..... 432/19; 432/17; 432/9; 432/103; 266/163; 75/671; 75/686; 75/687

(58) Field of Classification Search

USPC ..... 432/9, 103, 17, 19; 266/163
See application file for complete search history.

(56) References Cited

U.S. PATENT DOCUMENTS

| | | | | |
|---|---|---|---|---|
| 4,498,861 | A | 2/1985 | Suzuki et al. | |
| 4,673,025 | A * | 6/1987 | Mortimer | 164/457 |
| 5,540,752 | A * | 7/1996 | Spoel | 75/380 |
| 5,563,903 | A | 10/1996 | Jebrail et al. | |
| 5,599,182 | A | 2/1997 | Andrews et al. | |
| 5,609,481 | A | 3/1997 | Kobayashi | |
| 5,755,818 | A | 5/1998 | Tuson et al. | |
| 7,695,276 | B2 * | 4/2010 | Evans | 432/103 |
| 7,775,791 | B2 * | 8/2010 | Swanson et al. | 431/187 |
| 2002/0060383 | A1 * | 5/2002 | Yerushalmi | 266/163 |
| 2007/0119213 | A1 * | 5/2007 | Simpson et al. | 65/157 |
| 2009/0004611 | A1 | 1/2009 | Kobayashi | |
| 2009/0311639 | A1 | 12/2009 | Docquier et al. | |

FOREIGN PATENT DOCUMENTS

| | | | |
|---|---|---|---|
| CN | 1777777 | A | 5/2006 |
| CN | 101688662 | A | 3/2010 |
| EP | 0748982 | B1 | 12/1996 |
| EP | 0748993 | B1 | 12/1996 |
| EP | 0748994 | B1 | 12/1996 |

* cited by examiner

*Primary Examiner* — Kang Hu
*Assistant Examiner* — John Bargero
(74) *Attorney, Agent, or Firm* — Michael K. Boyer; Larry S. Zelson

(57) ABSTRACT

A method of heating a charge material by controlling heat flux in a tilt rotary furnace is disclosed. Combustion by the burner forms a heat release profile including a high heat flux region. The positioning of the high heat flux region is controllable by providing a controlled amount of secondary or staged oxidant. The burner is configured and controlled to position a region of high heat flux at a position corresponding to an area requiring greater heating, such as the area of maximum charge depth in the furnace to provide substantially uniform melting and heat distribution.

14 Claims, 6 Drawing Sheets

FIG - 10
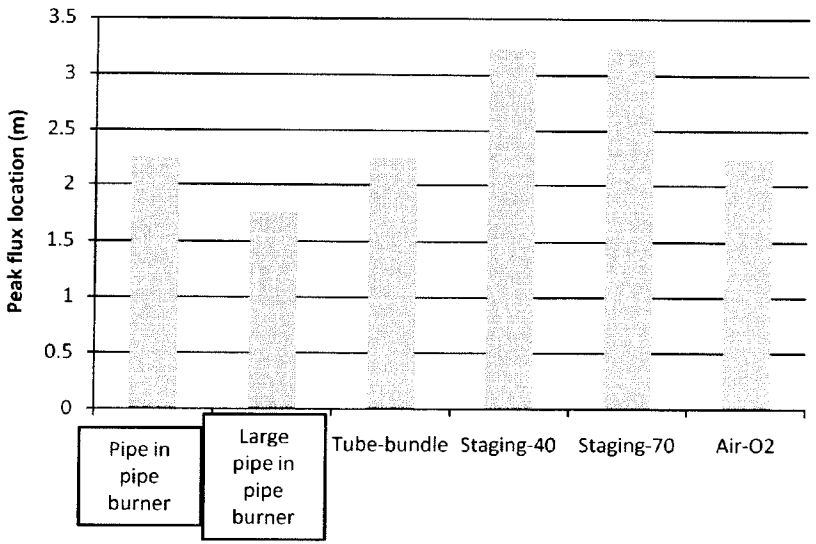
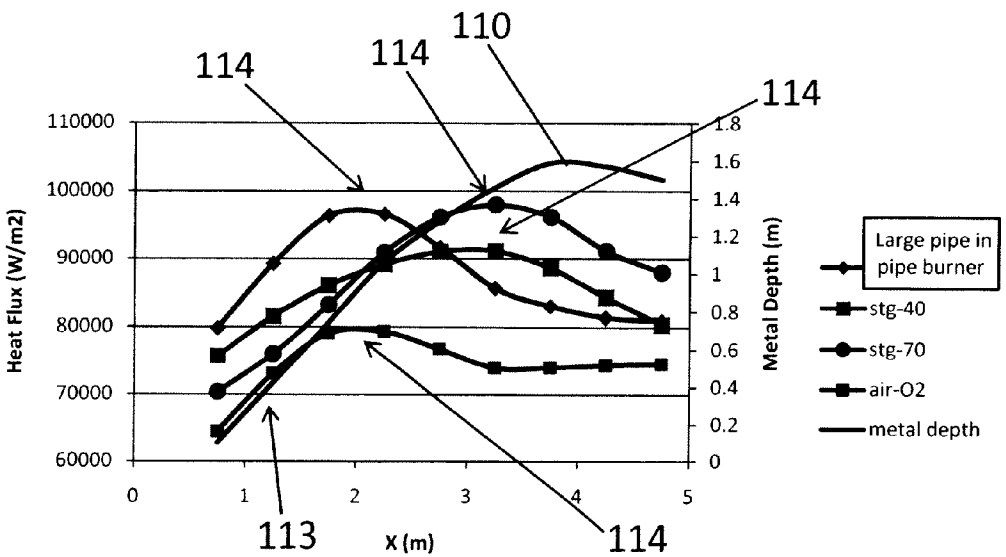
FIG - 11

SELECTIVE ADJUSTMENT OF HEAT FLUX FOR INCREASED UNIFORMITY OF HEATING A CHARGE MATERIAL IN A TILT ROTARY FURNACE

BACKGROUND OF THE INVENTION

The present disclosure is directed to melt furnace systems. More specifically, the disclosure is directed to tilt rotary furnace systems and methods for operating tilt rotary furnace systems.

Tilt rotary furnaces are used in processes like aluminum melting because they provide flexibility in metal tapping by furnace tilting. Three advantages include 1) they can operate with a much lower process temperature since a charge material can be removed by tilting (contrary to fixed-axis rotary furnaces where the process temperature is often well beyond what is needed for melting the charge material in order to liquefy the added flux to be removed after each cycle), 2) they can be emptied more thoroughly, and 3) they can reduce oxide formation on the charge material.

However, charge material distribution in a tilt rotary furnace is not uniform due to the tilt. Due to gravity, the charge material flows toward the end of the furnace above an edge of the furnace. Such load distribution is suboptimal to the conventional means of heat delivery, especially oxy-fuel burners, which tend to deliver relatively high heat flux in the flame vicinity. Known burners for use in tilt rotary furnaces lack the control to provide a heat release pattern corresponding to the positioning and depth of the charge material. Thus, these known burners provide too little heat to certain portions of the charge material or they waste heat by providing too much heat to other portions of the charge material. Because of this, known tilt rotary furnaces having known burner arrangements may have increased oxidation of metal and need to be cleaned frequently.

U.S. Pat. App. Pub. No. 2009/0004611 A1 is directed to a combustion method. In the method, an industrial furnace is heated by one or more burners. Examples of the furnaces include steel reheating furnaces, aluminum melting furnaces, glass melting furnaces, cement kilns, lead melting furnaces, copper melting furnaces, and iron melting furnaces. Fuel (for example, any combustible fluid) and primary oxidant (a fluid having an oxygen concentration of at least 50 volume percent) are provided to the furnace through the one or more burners. The fuel and primary oxidant are provided at flow rates having a stoichiometric ratio of primary oxygen to fuel of less than 70 percent. The fuel and primary oxidant are provided at velocity of 100 feet per second or less. Secondary oxidant is injected through a lance. Heat generated in a combustion reaction radiates to the charge to heat the charge. The heat radiates directly or indirectly through furnace gases and walls and very little heat is passed by convection. This Application discloses nothing about the selective adjustment of heat flux to achieve uniform heating to a melt with uneven depth using burners at the same firing rate.

U.S. Pat. No. 5,755,818A (corresponding to EP 0 748 982 B1) (the '818 patent) is directed to a method of staged combustion. The method is similar to that which is discussed in the '611 application; however, fuel and primary oxidant are provided at velocity of at least 100 feet per second. Like the '611 application, heat generated in a combustion reaction radiates to the charge to heat the charge, and the heat radiates directly or indirectly through furnace gases and walls and very little heat is passed by convection. Similarly, the '818 patent does not teach how to adjust the flame shape and length for different applications and different operational conditions.

U.S. Pat. No. 5,609,481 (corresponding to EP 0 748 994) (the '481 patent) is directed to a method of heating or melting a charge of material in a direct-fired furnace. In the method, the charge is heated by radiant heat from a direct-fired burner. A charge-proximal gas for increasing or decreasing oxidation is introduced between the direct-fired burner and the charge. The charge-proximal gas forms a stratum separating combustion products from the charge. The stratum can be adjusted to control oxidation of the charge. To maintain the stratum, fuel, oxidant, and the charge-proximal gas are introduced at velocities below 50 feet per second. The '481 patent suffers from several drawbacks. For example, the strata can be interrupted by mixing of the charge thus limiting the ability to distribute heat within the charge and reducing the ability to utilize convective heating.

The disclosure of the previously identified patents and patent applications is hereby incorporated by reference.

It is desirable in the art to provide methods for controlled heating of melt furnace systems which result in greater uniformity in melting, reduced oxidation of charged material, and more thorough emptying with fewer cleaning cycles.

BRIEF SUMMARY OF THE INVENTION

One aspect of the present disclosure includes a method of heating a charge material. The method includes providing a furnace for heating the charge material and controllably providing a first fuel and a first oxidant to a first injector and controllably providing one of a second fuel or a second oxidant to a second injector to form a heat release profile above the charge material, the heat release profile including a region of high heat flux at a controlled distance from a burner. The controlled distance corresponds to the location of greatest charge depth.

Another aspect of the present disclosure includes a tilt rotary furnace for heating a charge material. The furnace includes a rotatable portion including a vessel for receiving the charge material, the charge material having a depth profile including a location of greatest charge depth and a burner having a first injector and a second injector. The rotatable portion is adjustable between a first axis and a second axis. The furnace angle results in the charge material having a depth profile including a location of greatest charge depth. The burner controllably provides a first fuel and a first oxidant to the first injector and one of a second fuel or a second oxidant to the second injector to form a heat release profile above the charge material, the heat release profile including a region of high heat flux at a controlled distance from the burner. The controlled distance results in the region of high heat flux being proximal to one or more of a portion of a surface of the charge material corresponding to the point of greatest charge depth and a wall portion of the rotatable portion corresponding to the point of greatest charge depth.

Another aspect of the present disclosure includes a method of heating a charge material. The method includes providing a tilt rotary furnace for heating the charge material, controllably providing a first fuel and a first oxidant to a first injector and controllably providing one of a second fuel or a second oxidant to a second injector to form a heat release profile above the charge material (the heat release profile including a region of high heat flux at a controlled distance from the burner), determining a location of greatest depth in a depth profile of the charge material, and adjusting the heat release profile at controlled distance to correspond to the location of greatest depth, the controlled distance resulting in the region of high heat flux being proximal to one or more of a portion of a surface of the charge material corresponding to the point of greatest depth of the charge material and a wall portion of the rotatable portion corresponding to the point of greatest depth of the charge material.

The process includes selective adjustment of heat flux for increased uniformity of heating a charge material in a tilt rotary furnace. The system includes a tilt rotary furnace capable of selective adjustment of heat flux for increased uniformity of heating a charge material. The selective adjustment can be provided, for example, by fuel or oxidant staging.

The method includes positioning a region of high heat flux proximal to a portion of a charge material corresponding to the location of greatest depth of the charge material or being proximal to a wall portion of the rotatable portion corresponding to the location of greatest depth of the charge material.

The tilt rotary furnace includes a rotatable portion (for example, a barrel) and a non-rotatable portion, and a burner. The rotatable portion is adjustable between a first axis and a second axis, the first axis and the second axis being angles corresponding to different operational conditions for the tilt rotary furnace. In a tilt rotary furnace, the angle results in the charge material having a depth profile including a location of greatest charge depth. Combustion by the burner forms a heat release profile including a region of high heat flux. The burner can be adjusted by staging oxidant or fuel to position the region of high heat flux proximal to one or more of (1) a portion of a surface of the charge material corresponding to the location of greatest depth of the charge material and (2) a wall portion of the rotatable portion corresponding to the location of greatest charge depth of the charge material.

The region of high heat flux can be or include a point of high heat flux. The region on the surface of the charge material can be or include a location of greatest depth. As used herein, the term "high heat flux" refers to heat flux being above an amount of heat flux for a majority of the heat release profile and may include the maximum heat flux for the heat release profile.

Other features and advantages of the present invention will be apparent from the following more detailed description of the preferred embodiment, taken in conjunction with the accompanying drawings which illustrate, by way of example, the principles of the invention.

BRIEF DESCRIPTION OF SEVERAL VIEWS OF THE DRAWINGS

FIG. 10 shows a plot of results from computational fluid dynamics indicating a specific point of high heat flux for various burner configurations.

FIG. 11 shows a plot of results from computational fluid dynamics indicating a portion of heat release profiles for various burner configurations.

DETAILED DESCRIPTION OF THE INVENTION

Provided are methods and systems that provide controlled heating for melt furnace systems to provide greater uniformity in melting, reduces oxidation of the charge material, provides more thorough emptying and fewer cleaning cycles. Embodiments of the present disclosure provide further control of heat distribution through utilizing a burner capable of providing a heat release pattern corresponding to the positioning and depth of the charge material in a tilt rotary furnace. This increased heat distribution also minimizes metal oxidation and allows for more thorough emptying, which allows for fewer cleaning cycles.

Figure 1:
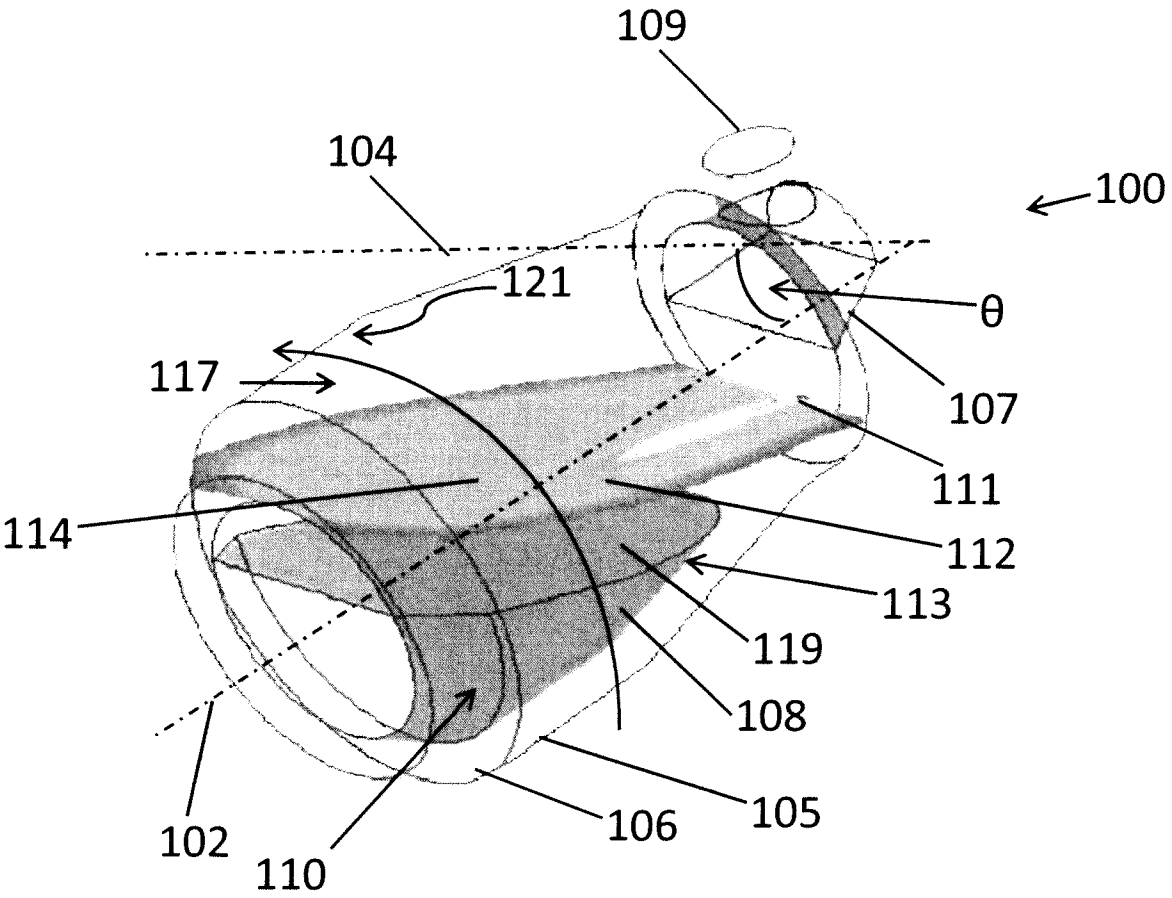
FIG. 1 is a transparent perspective view of an exemplary tilted rotary furnace in operation.

FIG. 1 shows an exemplary tilt rotary furnace 100. The furnace is adjustable between a position corresponding to a first axis 102 (for example, an angled position) and a second position corresponding to a second axis 104 (for example, a substantially horizontal position). The first axis 102 and the second axis 104 form an angle θ.

The furnace 100 includes a rotatable portion 105 having a first end 106 or load end rotatable about the first axis 102 while in the first position. The furnace 100 includes a second end 107 or burner end (proximal to a burner 111) that does not rotate about the first axis 102 or the second axis 104. However, the second end 107 is configured to permit adjustment of the furnace 100 between the first position corresponding to the first axis 102 and the second position corresponding to the second axis 104. The second end 107 includes an opening 109 permitting salt/flux to be added to charge material 108 (for example, aluminum, glass, cement, lead, copper, iron and steel, etc.) within the furnace 100.

When the furnace 100 is in the first position, the first end 106 of the furnace 100 contains a greater amount of charge material 108 in comparison to the other portions of the furnace 100. The angle of the first position (in conjunction with the shape of the chamber) results in the charge material 108 having a depth profile. The depth profile includes a location of greatest depth 110 (defined by a surface 119 of the charge material 108) and other regions with lower depth 113. The burner 111 can be controlled so that a region of high heat flux 114 in a heat release profile 112 formed by combustion corresponds to the location of greatest depth 110. High heat flux is an amount of heat flux that is greater than the average heat flux over the heat flux distribution for the heat release profile. Heat flux distributions may be represented by plots of heat flux versus distance from the burner (see e.g., FIG. 11). The region of high heat flux 114 may be, for example, the region between the locations (i.e. the distance from the burner) where the intersection of the heat flux distribution and the average heat flux for the entire heat release profile take place.

When the furnace 100 rotates, the wall portion 121 of the furnace 100 in the combustion region 117 rotates to be positioned below or underneath the charge material 108. Heat from the heated wall portion 121 then heats the charge material 108 by conduction. In one embodiment, for example, greater than one quarter of the heat provided to the charge 108 is provided by conduction between the wall portion 121 and the charge material 108. This comparative amount of heat from conduction can be based upon a predetermined location (for example, the location of greatest depth 110) or a region (for example, the region of high heat flux 114). That is, the location of greatest depth 110 may correspond to a circumferential wall portion 121 of the furnace 100, which is desirably heated with the region of high heat flux 114 to provide conductive heat to the bottom of the charge material 108.

Figure 2:
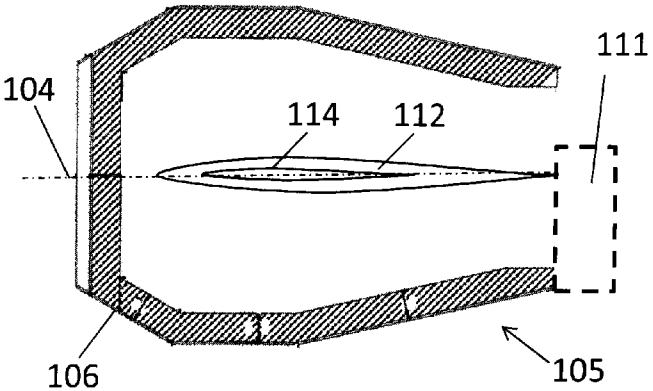

FIGS. 2-5 schematically illustrate the various positions of furnace 100 and the variability of the location of greatest depth and of location of circumferential wall portion 121. FIG. 2 shows the rotatable portion 105 at the second position (or loading position). While positioned in the second position, the rotatable portion 105 can rotate around the second axis 104. This position can be used for loading charge material 108, unloading charge material 108, and/or cleaning the furnace 100.

To achieve uniform heating, the heat transfer resulting from the heat release profile 112 needs be modified by selectively adjusting the burner 111 to position the region of high heat flux 114 closer to the location of greatest depth 110 and/or a wall portion 121 (see FIGS. 3-5) which rotates to be below the location of greatest depth 110.

The burner 111 is configured to selectively adjust the flame length and heat transfer, under the same firing rate, according to the depth of a melt. The adjustment of flame length and the positioning of the region of high heat flux 114 may be accomplished by oxidant or fuel staging. The adjustment of the flame length and heat transfer can be achieved by a staging burner 111 via adjusting the staging ratio In addition to the above, other methods for increasing the rate of melting and/or heating in combination with the adjustment of the heat release profile 112 may also be provided. For example, the amount of flux/salt added to the furnace 100 can be increased to increase the rate of melting and/or heating. In other embodiments, rates of rotation and/or tilt may also be utilized to alter the rate of melting and/or heating.

Figure 3:
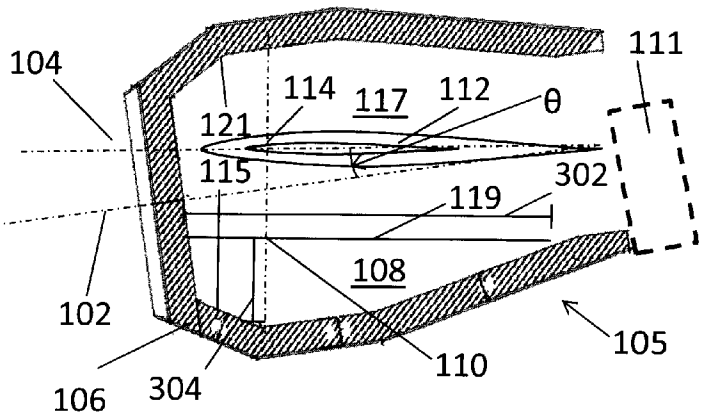
FIGS. 2-5 show sectioned views of a series of an exemplary tilted rotary furnace at various angles.
Figure 5:
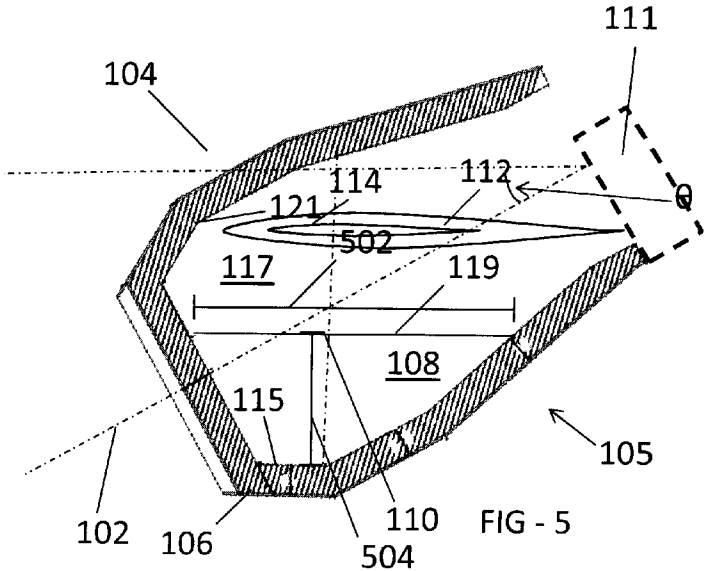
Figure 4:
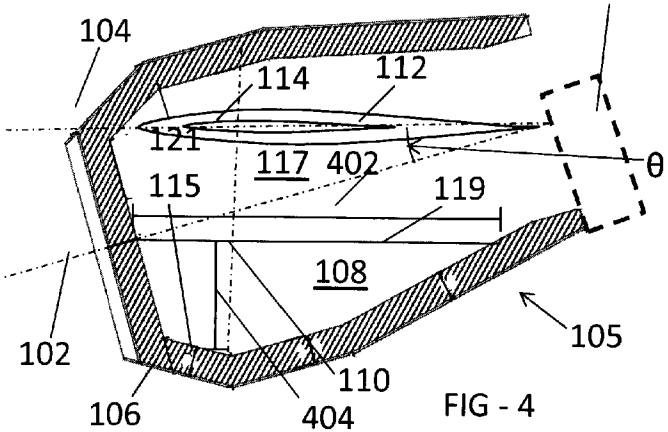

Referring to FIGS. 3-5, the location of greatest depth 110 along the surface 119 of the charge material 108 may shift based upon altered angle θ. Increasing the angle θ moves the location of greatest depth 110 toward the second end 107, closer to the burner 111 (see FIG. 1). In order to address various angles and/or furnace configurations, the burner 111 is configurable to provide a high heat flux 114 to the location of greatest depth 110. FIGS. 3-5 show the rotatable portion 105 of the furnace 100 at various values of the angle θ. For the shown configuration, the angle θ can be any suitable value up to about 30 to 35 degrees. As will be appreciated, the furnace 100 can include other designs permitting the value of the angle θ to be greater than 30 to 35 degrees. The burner 111 may be configured to provide a high heat flux profile 114 that is adjusted to correspond to the varying locations of greatest depth 110, or may be configured to provide a high heat flux 114 at a single location, a representative location and or location adjacent or near the location of greatest depth 110 corresponding to an operational condition, such as a melting cycle.

Although not to scale, each of FIGS. 3-5 is intended to exemplify the same volume of charge material 108 within the rotatable portion 105. The rotatable portion 1-5 can be configured with a geometry such that a maximum value for the angle θ would not shift the location of greatest depth 110 toward the first end 106 (for example, by having a rounded or angled interior corner 115 proximal to the first end 106). Similarly, the chamber 100 can be configured such that increasing the value for the angle θ decreases the amount of charge material 108 on the surface 119, thereby potentially reducing risk of oxidation.

In FIG. 3, the rotatable portion 105 is at the first position corresponding to the first axis 102. The value of the angle θ is about 5 degrees. The surface 119 has a predetermined length 302 and the location of greatest depth 110 has a predetermined depth 304.

In FIG. 4, the rotatable portion 105 is at the first position corresponding to the first axis 102. The value of the angle θ is about 20 degrees. The surface 119 has a predetermined length 402 that is shorter than the predetermined length 302 of the surface 119 shown in FIG. 3. In addition, the location of greatest depth 110 has a predetermined depth 404 that is greater than the predetermined depth 304 of the location of greatest depth 110 in FIG. 3. This decreased length 402 of the surface 119 and increased depth 404 are a result of the angle θ being greater. As can be seen in FIG. 4, the horizontal distance from the burner 111 to the location of greatest depth 110 is less than the horizontal distance from the burner in FIGS. 2 and 3. In order to provide a region of high heat flux 114 that corresponds to the location of greatest depth, the region of high heat flux 114 can be moved closer to the burner 111 than in FIGS. 2 and 3.

In FIG. 5, the rotatable portion 105 is at the first position corresponding to the first axis 102. The value of the angle θ is about 30 to 35 degrees. The surface 119 has a predetermined length 502 that is shorter than the predetermined length 402 of the surface 119 shown in FIG. 4. In addition, the location of greatest depth 110 has a predetermined depth 504 that is greater than the predetermined depth 404 of the location of greatest depth 110 in FIG. 4. This decreased length 502 of the surface 119 and increased depth 504 are a result of the angle θ being greater. As can be seen in FIG. 5, the horizontal distance from the burner 111 to the location of greatest depth 110 is less than the horizontal distance from the burner in FIGS. 2, 3 and 4. In order to provide a region of high heat flux 114 that corresponds to the location of greatest depth, the region of high heat flux 114 can be moved closer to the burner 111 than in FIGS. 2, 3 and 4.

Although the above description of FIGS. 2-5 refer to an active adjustment of the burner 111 to position the region of high heat flux 114, the region of high heat flux 114 may be positioned corresponding to a location of greatest depth 110 when the furnace 100 is performing a particular operational cycle, such as a melting cycle. The positioning of the region of high heat flux 114 can be achieved by selective adjustment of the burner 111 by altering staging ratios of oxidant or fuel.

Figure 6:
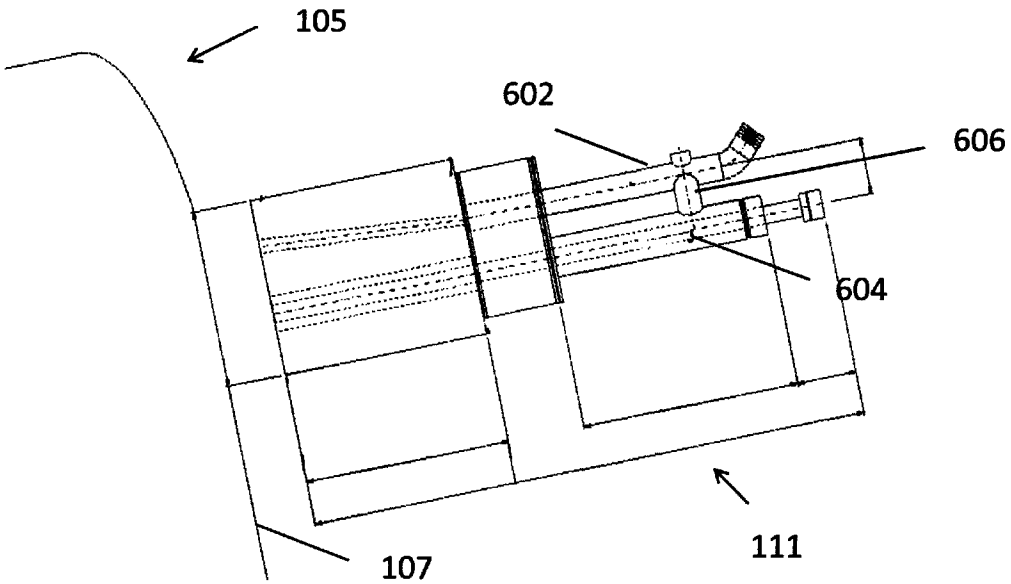
FIG. 6 shows an exemplary staged burner for a tilt rotary furnace.

FIG. 6 shows a schematic view of an exemplary staging burner 111 for the furnace 100. The burner 111 is configured to selectively adjust the heat release profile 112 (see FIG. 1). The burner 111 includes a first or primary injector 604 and second or secondary injector 602. For example, the burner 111 can selectively adjust the positioning of the region of high heat flux 114 within the chamber 100 and/or the intensity of the region of high heat flux 114 (see FIG. 1) by controlled introduction or staging of oxidant or fuel through a second injector 602. The burner 111 is positioned on the second end 107, just below the opening 109 (see FIG. 1) permitting salt/flux to be added to charge material 108. As used herein, "staging" means a diverting or dividing of fuel or oxidant flow to the first or primary injector to a second or secondary injector. Likewise, "staging ratio" is defined as the percentage amount of fuel or oxidant diverted to the second or secondary injector.

In a staging burner 111, fuel and oxidant are introduced via a first injector 604. The fuel is injected through a fuel pipe. Oxidant is introduced through the primary pipe surrounding the fuel pipe at a flow rate between 10-90% of the total oxidant flow rate going into the furnace through the burner. In one embodiment, a secondary oxidant is injected through a second injector 602 with an axis that intercepts that of the primary injector at a distance of 15-60 times the diameter of the primary injector to make the overall stoichiometric ratio between 20-100% of the theoretical stoichiometry needed for the complete combustion of the fuel used. A burner operated this way can increase the distance of high heat transfer location from the burner by 63%, when switching from no staging to 70% of the oxidant staged (see, for example, FIG. 12).

Oxidant provided to the first injector 604 and, in certain embodiments, second injector 602 includes oxygen from about 5 vol % to about 100 vol %. In one embodiment, the burner 111 is operated with oxidant containing 40 vol % oxygen combined with any suitable inert gas (for example, nitrogen). In another embodiment, the burner 111 is operated with the second injector 602 injecting 70 vol % oxygen combined with any suitable inert gas. The injection of oxidant may be at any suitable velocity and/or amount. For example, the velocity can be between about 5 feet per second and 200 feet per second.

The fuel provided to first injector 604 and, in certain embodiments, second injector 602 may be any suitable fuel. Suitable fuels may include combustible fluids, such as natural gas. In one embodiment, the injection of fuel in the first injector 604 may be at any suitable velocity and/or amount. For example, the velocity can be between about 5 feet per second and 200 feet per second. In combustion of natural gas in a rotary furnace, for example, the overall stoichiometric ratio is set between about 1.4 and about 2.2.

The burner 111 permits adjustments of the heat release profile 112 and thereby the location of the region of high heat flux 114. This adjustment is achieved by the oxidant staging, or controlling the oxygen flow through a diverter valve 606. In certain embodiments, when more oxygen is injected in the second injector 602, the combustion flame may be longer. Additionally or alternatively, in certain embodiments, the burner 111 reduces or substantially eliminates oxidation on the surface 119 of the charge material 108. For example, in these embodiments, the burner 111 injects the oxidant away from the hot metal of the furnace 100 through oxygen staging, wherein the fuel creates a reducing or non-oxidizing atmosphere adjacent to the surface of the charge material.

Figure 7:
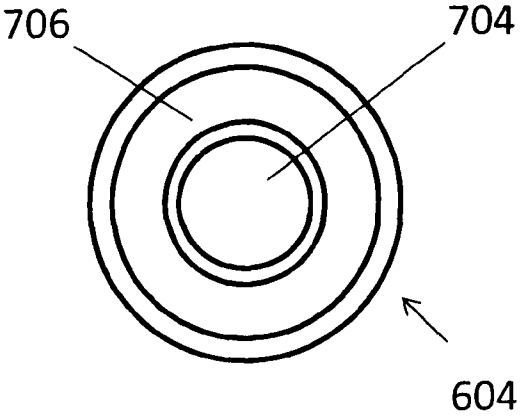
FIGS. 7-9 shows additional burners tested according to methods of the disclosure.

FIG. 7 shows a schematic end view of an injector 604. In injector 604, fuel is injected in a center fuel pipe 704, while the oxidant is injected in an annulus pipe 706. Both the center fuel pipe 704 and an annulus pipe 708 converge at the end of the injector 604 to support a flame. In staged burner 111, injector 604 is utilized in combination with a second injector 602 (see e.g. FIG. 6) that injects staged fuel or staged oxidant.

Figure 8:
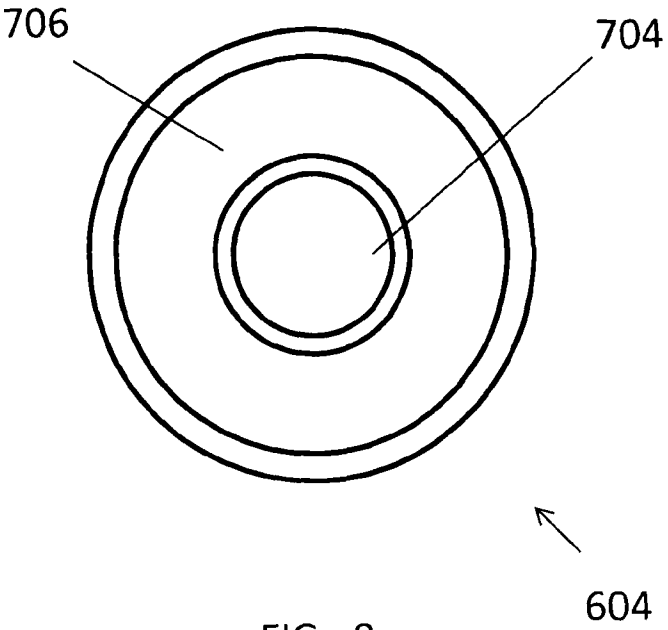

FIG. 8 shows a schematic end view of an injector 604 according to an alternate embodiment. In injector 604 of FIG. 8, fuel is injected in a center fuel pipe 704, while the oxidant is injected in an annulus pipe 706. Both the center fuel pipe 704 and an annulus pipe 708 converge at the end of the injector 604 to support a flame. In staged burner 111, injector 604 is utilized in combination with a second injector 602 (see e.g. FIG. 6) that injects staged fuel or staged oxidant. Injector 604 of FIG. 8 is similar to the injector 604 of FIG. 7; however, the center fuel pipe 704 and annulus pipe 706 of FIG. 8 are larger in than the center fuel pipe 704 and the annulus pipe 706 of FIG. 7. The larger size accommodates higher firing rates of injector 604 and burner 111.

Figure 9:
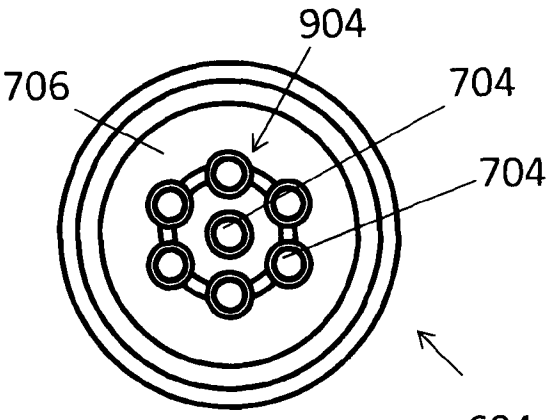

FIG. 9 shows a schematic end view of an injector 604. The injector 604 includes a plurality of fuel pipes 704 for injecting fuel and an annulus pipe 708 for injecting oxidant. The plurality of fuel pipes 704 introduce a combustible fuel surrounded by oxidant. In staged burner 111, injector 604 is utilized in combination with a second injector 602 (see e.g. FIG. 6) that injects staged fuel or staged oxidant. The injector 604 shown in FIG. 9 provides intense mixing.

EXAMPLES

Figure 12:
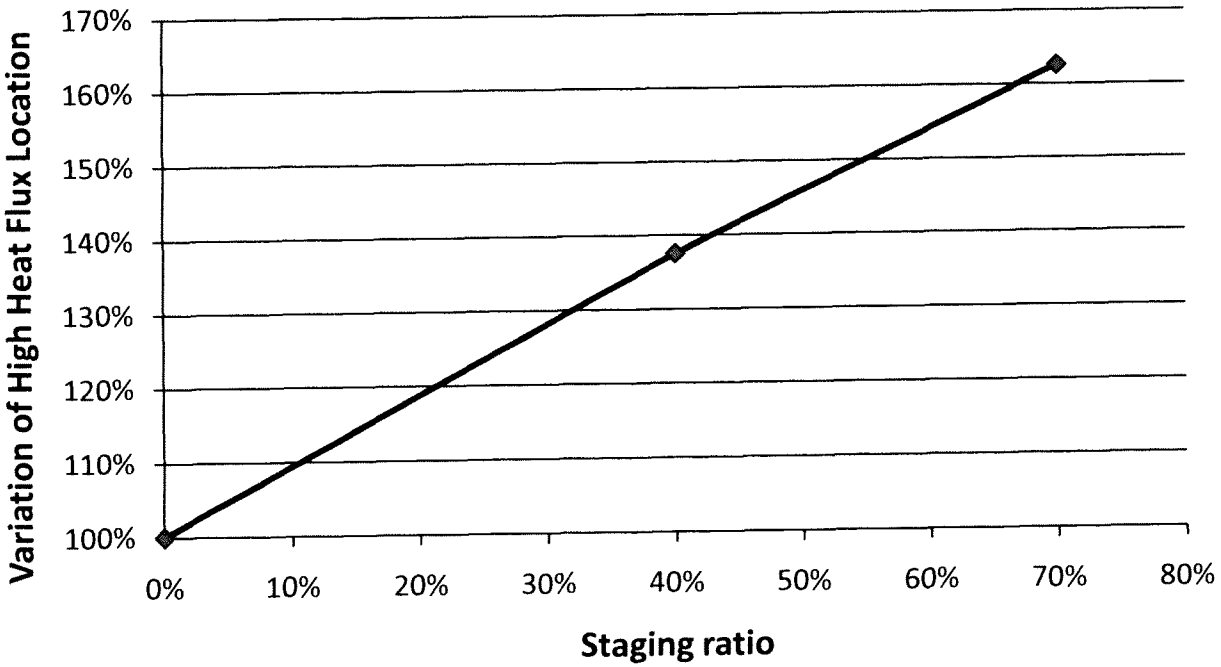
FIG. 12 shows a plot of results from computational fluid dynamics indicating relative positions of high heat flux location with respect to staging ratio.

Different configurations of burners have been analyzed to compare the ability to correspond the region of high heat flux 114 to the location of greatest depth 110 and/or the wall portion 121 which rotates to be below the location of greatest depth 110. Calculations have been facilitated by a Computational Fluid Dynamic (CFD) software program and assumptions common to those skilled in the art have been made. Referring to FIG. 10-12, various burner configurations and staging ratios are analyzed in view of a total volume within the furnace 100 being about 37.4 $m^3$, a volume of the combustion region 117 being about 26.6 $m^3$, a volume of the charge material 108 being about 10.8 $m^3$, the charge material 108 having a melting point of about 900K, the angle θ being about 20 degrees, the location of greatest depth 110 being at about 3.80 m, firing of the burner at about 10 mmbtu, and a rotational velocity of the rotatable portion 105 being about 3 revolutions per minute. In addition, burner 111 is analyzed by adjusting oxidant flow through the second injector. Oxidant utilized in the analysis is 100% oxygen.

As shown in FIG. 10, a burner having the configuration as shown in FIG. 7 ("Pipe in pipe burner") with no staging includes a specific point of high heat flux at about 2.25 m from the burner. A burner having the configuration shown in FIG. 8 ("Large pipe in pipe burner") with no staging includes a specific point of high heat flux at about 1.75 m from the burner. A burner having the configuration shown in FIG. 9 ("Tube-bundle") with no staging includes a specific point of high heat flux at about 2.25 m from the burner. A burner ("Staging-40" and "Stg-40") is operated with 40 vol % of the oxidant flow or a staging ratio of 40% flowing through the second injector includes a specific point of high heat flux at about 3.25 m from the burner. A burner ("Staging-70" and "Stg-70") is operated with 70 vol % of the oxidant flow or a staging ratio of 70% flowing through the second injector includes a specific point of high heat flux at about 3.25 m from the burner. A burner ("Air—$O_2$") is operated with a predetermined mixture of air and oxygen as the oxidant includes a specific point of high heat flux at about 2.25 m from the burner.

The specific points of high heat flux indicate that the burner that is operated with 40 vol % oxygen flowing through the second injector or 70 vol % oxygen flowing through the second injector are closest to the location of greatest depth 110 within the charge material 108.

As shown in FIG. 11, the heat release profile 112 (including the region of high heat flux 114) has been analyzed for each of the conditions described with reference to FIG. 10. The heat release profile for the individual burners, includes varying regions of high heat flux. The region of high heat flux, as utilized in these examples, is the region between the locations (i.e. the distance from the burner) where the intersection of the heat flux distribution and the average heat flux for the entire heat release profile take place. For example, the Large Pipe in pipe burner with no staging includes a region of high heat flux between about 1.2 m and about 3 m from the burner. The Stg-40 burner, which is operated with 40 vol % of the oxidant flow or a staging ratio of 40% flowing through the second injector includes a region between about 1.6 m and about 4.2 m from the burner. The Stg-70 burner, which is operated with 70 vol % of the oxidant flow or a staging ratio of 70% flowing through the second injector includes a region between about 2.1 m and about 4.6 m from the burner.

In addition, the depth profile of the charge material 108 has been plotted (including the location of greatest depth 110 and other regions with lower depth 113). The calculations show that, although the specific points of high heat flux for the burner that is operated with 40% staging ratio through the second injector and the burner that is operated with 70% staging ratio through the second injector are substantially the same, the overall region of high heat flux 114 is farther from the burner for the burner that is operated with 70% staging ratio through the second injector. Specifically, the burner that is operated with 40% staging ratio through the second injector has a higher heat flux until about 2 m and a lower heat flux beyond 2 m (in comparison to the burner that is operated with 70% oxidant flowing through the second injector). Thus, the heat release profile 112 of the burner that is operated with 70% oxidant flowing through the second injector releases a larger portion of its overall heat in the region proximal to the point of greatest depth 110.

Additionally, the calculations show that the burner configurations results in a difference in oxygen at the surface 119 of the charge material 108. Specifically, the burner 702 has an oxygen content of about 2.47% at the surface 119, the burner that is operated with 40% oxidant flowing through the second injector has an oxygen content of about 0.95% at the surface of the charge material, the burner that is operated with 70% staging through the second injector has an oxygen content of about 0.94% at the surface of the charge material, and the burner 111 that is operated with air had an oxygen content of about 3.07% at the surface 119.

As shown in FIG. 12, a burner that is operated with oxidant staging of varying percentages is analyzed to determine the position of high heat flux. As shown in FIG. 12 the variation of high heat flux is a percentage of the length from the burner with 100% being the positioning of the location of high heat flux corresponding to a non-staged burner. The distance of the location of high heat flux from the burner increases with increased staging ratio.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of heating a charge material in a furnace in which the charge material has a depth profile including a location of greatest charge depth, the method comprising:

injecting a first fuel and a first oxidant into the furnace through a first injector of a burner;

injecting one of a second fuel and a second oxidant into the furnace through a second injector of the burner in a staging ratio, wherein the staging ratio is a percentage of fuel or oxidant injected via the burner through the second injector;

determining the location of greatest depth of the charge material;

adjusting the staging ratio to form a region of high heat flux at a controlled distance from the burner corresponding to the location of greatest charge depth; and repeating the determining and adjusting steps as necessary to maintain a correspondence between the controlled distance of the region of high heat flux and the location of greatest charge depth.

2. The method of claim 1, wherein the region of high heat flux is proximal to a portion of a surface of the charge material corresponding to the location of greatest depth of the charge material.

3. The method of claim 1, wherein the region of high heat flux is proximal to a wall portion of the furnace corresponding to the location of greatest depth of the charge material.

4. The method of claim 1, wherein the controlled distance is a location proximal to the location of greatest depth for an operational condition of the furnace.

5. The method of claim 4, wherein the operational condition of the furnace is a melt cycle.

6. The method of claim 1, further comprising modifying the heat release profile by selectively adjusting the burner.

7. The method of claim 1, wherein the first injector directs the first fuel to an area adjacent the surface of the charge material.

8. The method of claim 1, further comprising melting the charge material.

9. The method of claim 1, wherein the charge material is selected from the group consisting of aluminum, glass, cement, lead, copper, iron and steel.

10. The method of claim 1, wherein the second fuel is provided to the second injector.

11. The method of claim 1, wherein the second oxidant is provided to the second injector.

12. The method of claim 10, wherein the second fuel is a portion of the first fuel.

13. The method of claim 11, wherein the second oxidant is a portion of the first oxidant.

14. A method of heating a charge material in a tilt rotary furnace in which the charge material has a surface and a depth profile, the method comprising:

injecting a first fuel and first oxidant into the furnace through a first injector of a burner;

injecting one of a second fuel and a second oxidant into the furnace through a second injector of the burner in a staging ratio, wherein the staging ratio is a percentage of fuel or oxidant injected via the burner through the second injector;

determining a location of greatest charge depth in the depth profile; and adjusting the staging ratio to form a region of high heat flux at a controlled distance from the burner to correspond to the location of greatest charge depth, the controlled distance resulting in the region of high heat flux being proximal to one or more of:

a portion of the surface of the charge material corresponding to the location of greatest depth of the charge material; and a wall portion of the rotary furnace corresponding to the location of greatest depth of the charge material; and repeating the determining and adjusting steps as necessary to maintain a correspondence between the controlled distance of the region of high heat flux and the location of greatest charge depth.

* * * * *